United States Patent [19]

Kaminaga

[11] Patent Number: 4,565,040

[45] Date of Patent: Jan. 21, 1986

[54] UNIT CURTAIN WALL

[75] Inventor: Hiromitsu Kaminaga, Kurobe, Japan

[73] Assignee: Yoshida Kogyo K.K., Tokyo, Japan

[21] Appl. No.: 600,162

[22] Filed: Apr. 13, 1984

[30] Foreign Application Priority Data

Apr. 14, 1983 [JP] Japan ..... 58-54781[U]

[51] Int. Cl.[4] ..... E04H 1/00

[52] U.S. Cl. ..... 52/235; 52/573; 52/486

[58] Field of Search ..... 52/235, 483, 167, 573, 52/64, 506, 510, 511, 134, 486

[56] References Cited

U.S. PATENT DOCUMENTS 4,070,835 1/1978 Reverend et al. ..... 52/486 X

FOREIGN PATENT DOCUMENTS 2364224 11/1975 Fed. Rep. of Germany ..... 52/235

57-11976 3/1982 Japan ..... 52/235

720114 3/1980 U.S.S.R. ..... 52/235

*Primary Examiner*—Carl D. Friedman

*Assistant Examiner*—Naoko N. Slack

*Attorney, Agent, or Firm*—Hill, Van Santen, Steadman & Simpson

[57] ABSTRACT

Horizontally adjacent curtain wall units are supported by a fastener on a building skeleton frame. The curtain wall units have brackets, respectively attached to their confronting vertical frame members, each bracket having a hooked arm. The fastener includes a first fastener member positionally adjustably fastened to the building skeleton frame and a second fastener member adjustably attached to the first fastener member and having a narrow and wide slot. One of the hooked arms is fixedly engaged in the narrow slot and the other hooked arm is received in the wide slot for horizontal movement therein. The bracket and hence the vertical frame member attached thereto is allowed to move horizontally parallel to the curtain wall units.

8 Claims, 5 Drawing Figures

UNIT CURTAIN WALL

BACKGROUND OF THE INVENTION

1. Field of the Invention:

The present invention relates to a unit curtain wall having a plurality of curtain wall units connected to and hung by fasteners on the exterior structural frame of a building.

2. Prior Art:

Japanese Patent Publication No. 57-11976 published on Mar. 8, 1982 discloses a unit curtain wall having a plurality of curtain wall units mounted to a building skeleton frame by fasteners. Each of the fasteners has a support secured to the building frame and a hook-shaped bracket attached to an edge of each curtain wall unit. The bracket and the support are held in engagement with each other and then are joined together by means of threaded fasteners, welding or the like. According to the prior unit curtain wall structure, adjacent curtain wall units are horizontally immovable with respect to one another in a plane parallel to the curtain wall units. Such unit curtain wall is likely to be damaged at the fasteners when the curtain wall units are thermally deformed or displaced between building floors.

SUMMARY OF THE INVENTION

It is therefore an object of the present invention to provide a unit curtain wall having curtain wall units connected to a building frame by fasteners capable of absorbing thermal deformations and displacements of the curtain wall units between building floors.

Another object of the present invention is to provide a unit curtain wall having curtain wall units which are horizontally movable with respect to one another in a plane substantially parallel to the curtain wall units.

According to the present invention, each pair of horizontally adjacent curtain wall units is supported by a fastener on a building skeleton frame. The curtain wall units have engagement portions in the form of brackets, respectively, attached to their confronting vertical frame members and hooked arms, respectively. The fastener includes a first fastener member adjustably secured to the building skeleton frame and a second fastener member adjustably attached to the first fastener member and having a pair of slots having different widths. One of the hooked arms is fixedly received in one or a narrow slot and the other hooked arm is received in another or a wide slot. The wide slot in the second fastener member allows the bracket and hence the vertical frame member attached thereto to move horizontally parallel to the curtain wall units.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
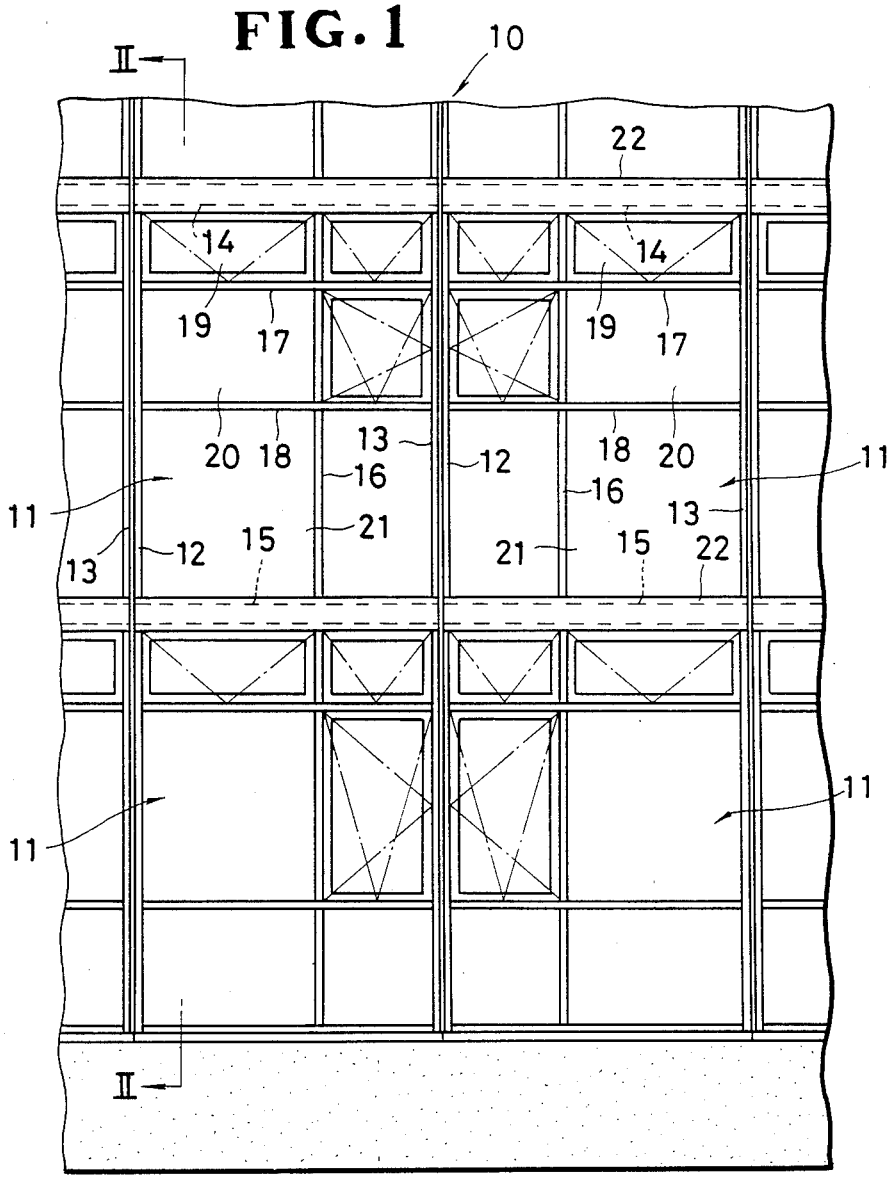
FIG. 1 is a fragmentary front elevational view of a unit curtain wall according to the present invention.
Figure 2:
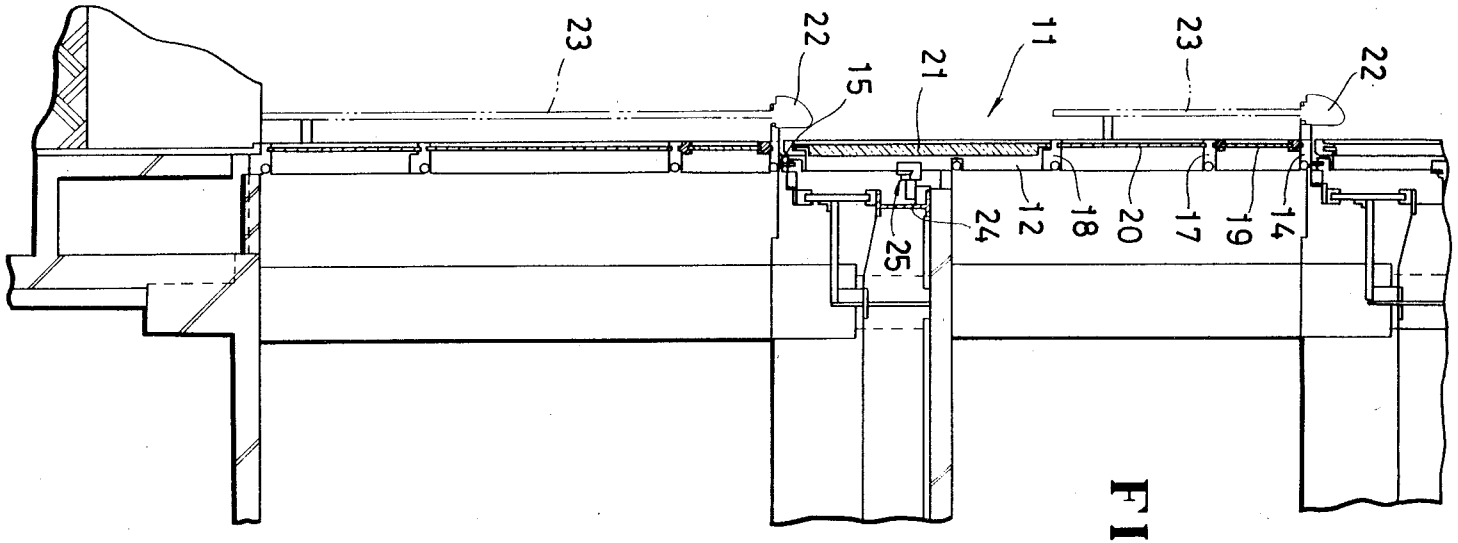
FIG. 2 is a fragmentary vertical cross-sectional view taken along line II—II of FIG. 1.

As shown in FIG. 1, a unit curtain wall 10 comprises a plurality of curtain wall units 11 arranged in a checkerboad pattern to cover an exterior side of a building. Each of the curtain wall units 11 has a pair of lateral vertical mambers 12, 13 and a pair of upper and lower horizontal members 14, 15 extending between and interconnecting the lateral vertical members 12, 13 to provide a rectangular frame. An intermediate vertical member 16 extends parallel to the vertical members 12, 13 between the horizontal members 14, 15 and a pair of parallel spaced intermediate horizontal members 17, 18 extends between the vertical members 12, 13 so as to define with the members 12–15 a total of six openings. A corresponding number of panel members are mounted in the frame's openings, the panel members including windows 19, pairs of panes of glass 20, and glass-and-thermal insulator composite panels 21. A blind holder 22 is mounted on the exterior side of each curtain wall unit 11 along the length of the upper horizontal member 14 for housing a blind 23 (FIG. 2). The curtain wall units 11 are connected to and hung on building skeleton frame members 24 by a plurality of fasteners 25, only one of each of the parts 24, 25 being shown in FIG. 2. The building skeleton frame 24 is a steel I-beam.

Figure 3:
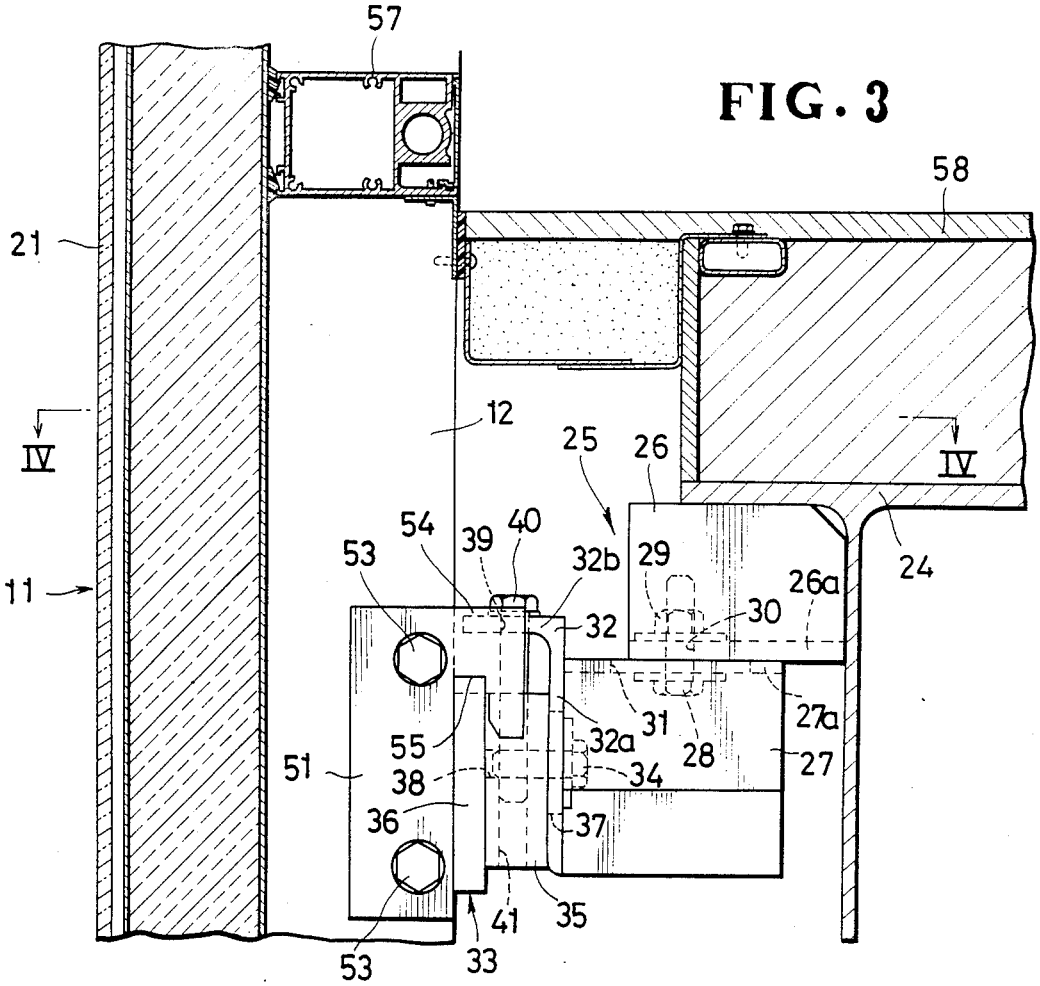
FIG. 3 is an enlarged cross-sectional view of a portion of the unit curtain wall having a fastener.
Figure 4:
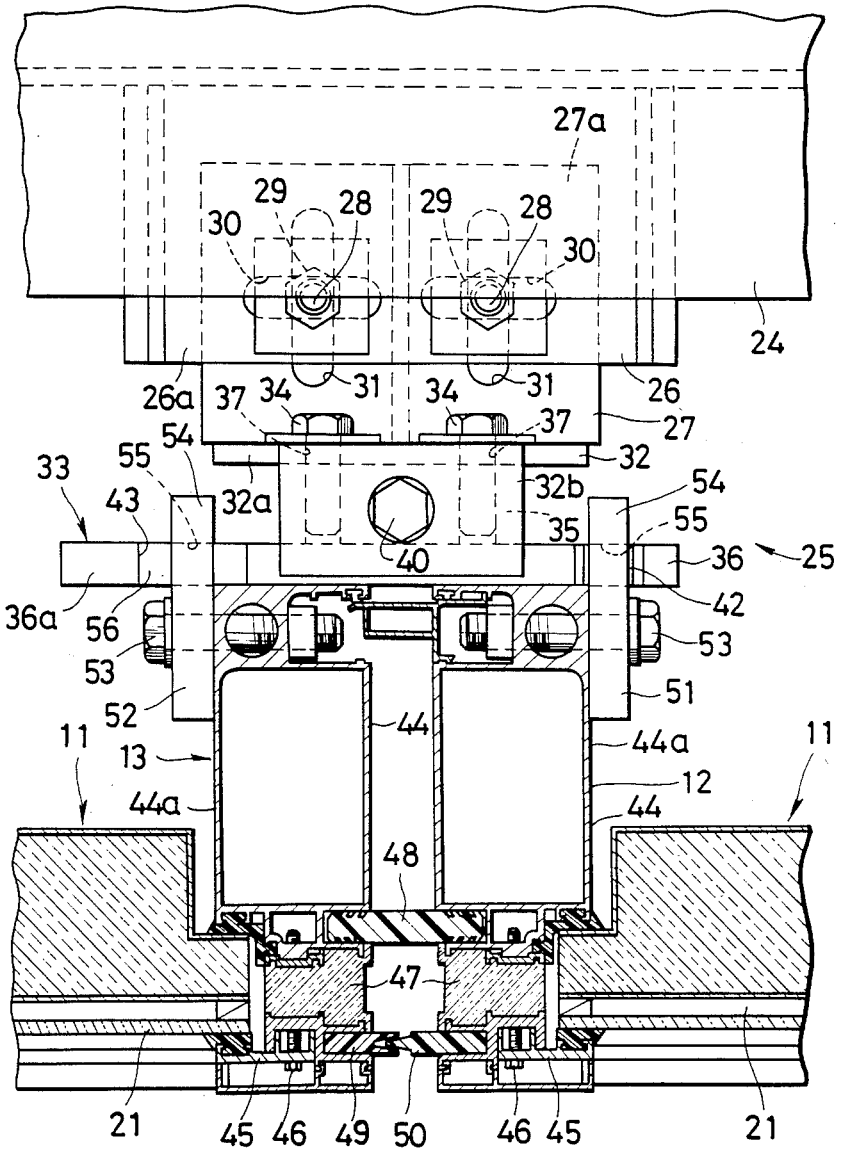
FIG. 4 is a cross-sectional view taken along line IV—IV of FIG. 3.
Figure 5:
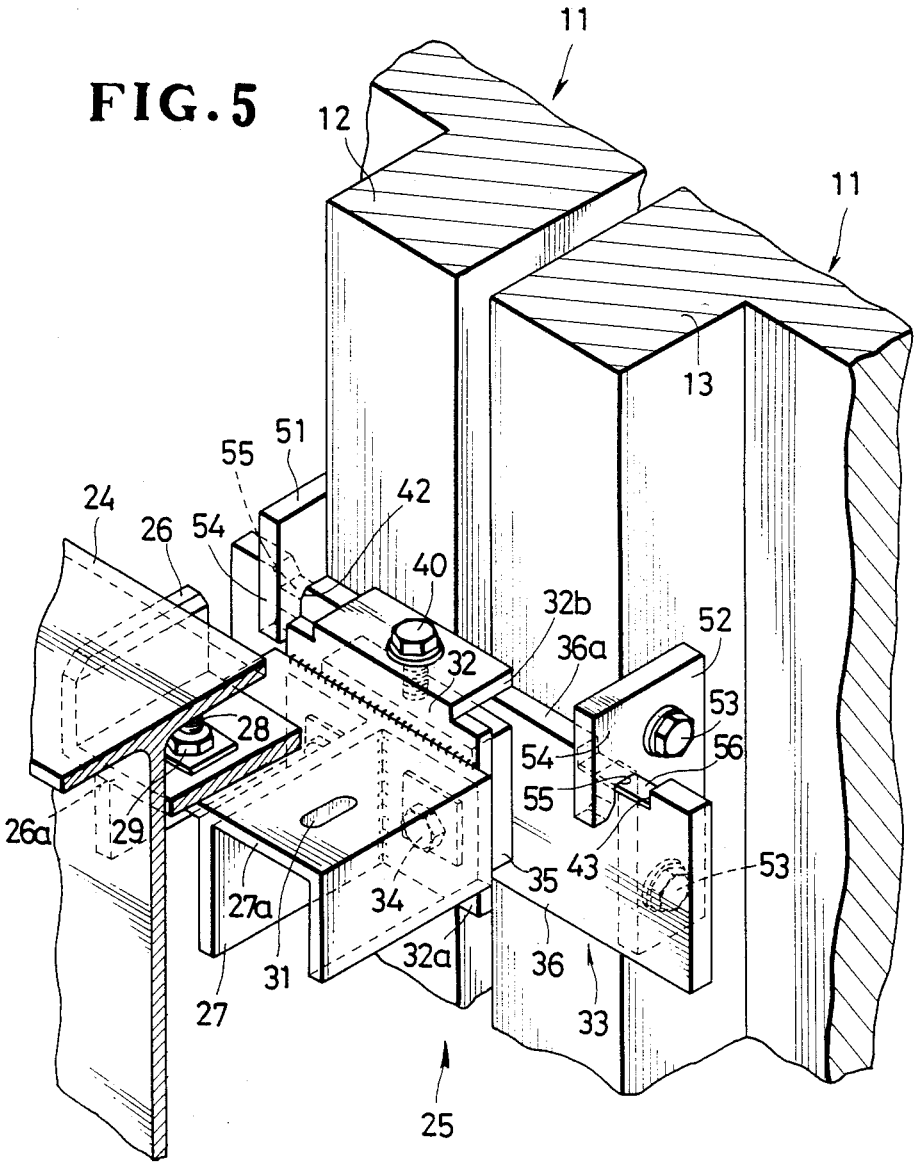
FIG. 5 is a fragmentary perspective view, with parts cut away, of the portion shown in FIGS. 3 and 4.

As shown in FIGS. 3 to 5, a channel-shaped mounting base 26 is welded to the underside of an upper flange of the I-beam 24. The fastener 25 includes a first E-shaped fastener member 27 adjustably connected to the mounting base 26 by means of bolts 28 and nuts 29. A bottom wall **26*a* of the mounting base 26 has a pair of slots 30 extending longitudinally of the I-beam 24 parallel to the curtain wall units 11. An upper wall 27*a* of the first fastener member 27 has a pair of slots 31 extending transversely to the I-beam 24 perpendicularly to the curtain wall units 11. The bolts 28 extend through the slots 30, 31 with nuts 29 threaded onto the bolts 28. Before the nuts 29 are tightened, the first fastener member 27 is adjusted in position with respect to the mounting base 26 and hence the I-beam 24 so that it will be located across the vertical frame members 12, 13 of each pair of adjacent curtain wall units 11 and spaced properly from the vertical frame members 12, 13. After the first fastener member 27 has thus been positioned, the nuts 29 are tightened on the bolts 28. An inverted L-shaped end plate 32 has a vertical wall 32*a* welded to the fore end of the first fastener member 27**.

The fastener 25 further includes a second T-shaped fastener member 33 fixed to the vertical wall **32*a* of the end plate 32 by means of screws 34. The second fastener member 33 includes a block 35 and a substantially rectangular support plate 36 fixedly secured to the block 35 and facing toward the vertical frame members 12, 13. The screws 34 extend through vertical slots 37 in the vertical wall 32*a* and then are threaded into an internally threaded horizonatal bore 38 in the block 35**.

The end plate 32 has a horizontal wall **32*b* having a hole 39 through which an adjusting screw 40 extends. The adjusting screw 40 is then threaded into an internally threaded vertical bore 41 in the block 35. The second fastener member 33 can be vertically adjusted in position along the vertical slots 37 by rotating the adjusting screw 40**.

The support plate 36 extends across the adjacent vertical frame members 12, 13 and projects laterally beyond outer side surfaces, respectively, of the latter. The support plate 36 has in its upper surface 36*a* a first slot 42 disposed closely to one end thereof and a second slot 43 disposed closely to an opposite end thereof, the second slot 43 being wider than the first slot 42.

As shown in FIG. 4, each of the vertical frame members 12, 13 includes a frame body 44 and a holder bar 45 fixed to the frame body 44 by screws 46 (one shown) with a thermally insulating connector 47 placed between the frame body 44 and the holder bar 45. The frame bodies 44, 44 of the adjacent frame members 12, 13 are relatively movably interconnected by an interior packing band 48. Likewise, the holder bars 45, 45 of the adjacent frame members 12, 13 are relatively movable in a direction parallel to the curtain wall units 11, 11 by means of a pair of confronting second exterior packing bands 49, 50.

As best shown in FIGS. 4 and 5, a pair of engagement portions in the form of a pair of brackets 51, 52 is attached by a pair of screws 53 to the outer side surfaces 44*a*, respectively, of the frame bodies 44 of the adjacent vertical frame members 12, 13. Each of the brackets 51, 52 has a hooked arm 54 extending normal to the frame body 44 and defining therein a downwardly opening recess 55. The hooked arm 54 of the bracket 51 interlockingly engages in the first slot 42 in the support plate 36, while the hooked arm 54 of the bracket 52 is received in the second slot 43 in the support plate 36 for lateral movement on the support plate 36. Thus, the vertical frame member 12 is fixedly hung by the support 36, namely the second fastener member 33 against any movement perpendicular to and parallel to the curtain wall units 11, and the vertical frame member 13 is hung by the second fastener member 33 against movement perpendicular to the curtain wall units 11, but is allowed to move in a plane parallel to the curtain wall units by means of the second slot 43. In the illustrated embodiment, the first slot 42 has a width substantially the same as the thickness of the bracket 51. On the other hand, the second slot 43 has a width substantially three times as great as the thickness of the bracket 52, as shown in FIG. 4. The first slot 42 has a pair of upwardly diverging sidewalls for receiving the hooked arm 54 of the bracket 51 with utmost ease. The second slot 43 has affixed thereto a layer 56 of low frictional resistance material such as a polyfluoroethylene film so as to allow the bracket 52 to move smoothly in a direction parallel to the curtain wall units 11.

A transverse frame member 57 (shown in FIG. 3) extends between the vertical frame members 12, 13 and attached thereto, the composite panel 21 being disposed against an exterior face of the transverse frame member 57 with gaskets interposed therebetween. A floor plate 58 is supported on the upper flange of the I-beam 24 with a suitable flooring material disposed therebetween.

With the foregoing arrangement, the vertical frame members 13 are horizontally movable with respect to the fasteners 25 for taking up any unwanted individual thermal deformations and displacements of curtain wall units 11 to thereby prevent the unit curtain wall 10 from being damaged particularly at the fasteners 25. The fasteners 25 can be adjusted in position on the building skeleton frame members 24 for proper alignment with the vertical frame members 12, 13 of the curtain wall units 11.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A unit curtain wall comprising:

(a) a plurality of curtain wall units;

(b) a pair of first and second engagement portions disposed on horizontally adjacent vertical edges of each pair of adjacent curtain wall units; and (c) a fastener adapted to be adjustably mounted on a building frame and supporting said pair of adjacent curtain wall units, said fastener having a pair of first and second slots receiving said first and second engagement portions, respectively, said first slot having a width small enough to prevent said one engagement portion from moving horizontally parallel to said curtain wall units, said second slot having a width large enough to allow said second engagement portion to move horizontally parallel to said curtain wall units, whereby one of said pair of adjacent curtain wall units is postionally movable with respect to said fastener in a direction horizontally parallel to said curtain wall units.

2. A unit curtain wall according to claim 1, said engagement portions comprising brackets attached to said horizontally adjacent edges, respectively.

3. A unit curtain wall according to claim 1, each of said curtain wall units including a pair of horizontally spaced vertical frame members, said engagement portions being disposed on said vertical frame members of the adjacent curtain wall units.

4. A unit curtain wall according to claim 3, said engagement portions comprising a first and a second bracket secured to said vertical frame members, respectively.

5. A unit curtain wall according to claim 4, said brackets having hooked arms extending in a direction normal to said curtain wall units, said hooked arm of said first bracket being fitted in said first slot against movement parallel to and perpendicular to said curtain wall units, said hooked arm of said second bracket being received in said second slot against movement perpendicular to said curtain wall units.

6. A unit curtain wall according to claim 1, said second slot having a layer of low frictional resistance material.

7. A unit curtain wall according to claim 6, said layer comprising a film of low frictional resistance material affixed to said second slot.

8. A unit curtain wall according to claim 1, said fastener comprising a first fastener member adapted to be mounted on the building frame for positional adjustment in a first direction parallel to said curtain wall units and also in a direction perpendicular to said first direction, and a second fastener member mounted on said first fastener member for vertical positional adjustment, said second fastener member having said first and second slots.

* * * * *